United States Patent [19]

Stenild

[11] Patent Number: 4,607,579

[45] Date of Patent: Aug. 26, 1986

[54] APPARATUS FOR DISPERSING A DYE OVER SECURITIES IN A CLOSED SPACE AT ATTEMPTS AT BURGLARY

[76] Inventor: Eddie L. Stenild, 2, Fugleb kvej, Kastrup, 2770, Denmark

[21] Appl. No.: 545,391

[22] PCT Filed: Feb. 16, 1983

[86] PCT No.: PCT/DK83/00015

§ 371 Date: Oct. 18, 1983

§ 102(e) Date: Oct. 18, 1983

[87] PCT Pub. No.: WO83/02975

PCT Pub. Date: Sep. 1, 1983

[30] Foreign Application Priority Data

Feb. 18, 1982 [DK] Denmark ..... 715/82

[51] Int. Cl.[4] ..... E05G 3/00

[52] U.S. Cl. ..... 109/25; 109/33; 109/20; 52/232

[58] Field of Search ..... 109/2, 20, 25, 36, 37, 109/38, 29–33; 52/232, 106; 101/3 R, 32; 222/94, 95, 389

[56] References Cited

U.S. PATENT DOCUMENTS

| | | | |
|---|---|---|---|
| 1,646,687 | 10/1927 | Daly | 109/25 |
| 1,892,050 | 12/1932 | Goss | 109/20 |
| 1,912,055 | 5/1933 | Young | 109/20 |
| 2,035,498 | 3/1936 | Navis et al. | 109/25 |
| 3,344,757 | 10/1967 | Touyet | 109/25 |
| 3,380,383 | 4/1968 | Schwepfe, Jr. | 222/389 |

*Primary Examiner*—Thomas J. Holko
*Assistant Examiner*—Neill Wilson
*Attorney, Agent, or Firm*—Dressler, Goldsmith, Shore, Sutker & Milnamow, Ltd.

[57] ABSTRACT

A pipe system for marking bank notes or other articles of value in a closed space with a dye at attempts at burglary comprises pipes shaped as oblong profiled housings (3). Each housing (3) contains a pressure rail (5) which will be pressed up against a dye bag (4) when an explosive charge (9) is ignited. Thereby the bag (4) will burst, and the dye will be sprayed upon the bank notes through a slot (2) in the bottom (1) of a tray carrying the notes. The spraying will occur practically at the same time along the entire slot (2), and any risk that spraying should be insufficient at some places because of pressure drop in the pipe lines is eliminated. The pressure rail (5) and the profiled housing (3) can be extruded at relatively small costs.

8 Claims, 5 Drawing Figures

Figure 1:
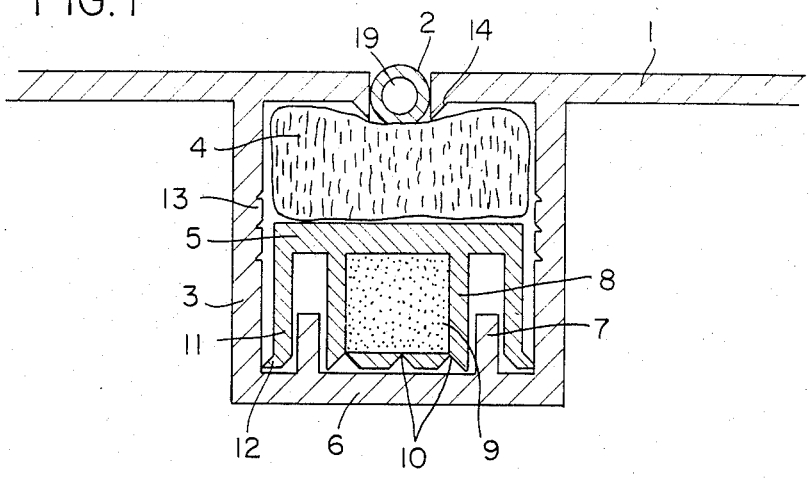

APPARATUS FOR DISPERSING A DYE OVER SECURITIES IN A CLOSED SPACE AT ATTEMPTS AT BURGLARY

The present invention relates to an apparatus for dispersing a dye over securities kept in a closed space, at attempts to break open such a space, e.g. a trunk or a safe-deposit box, and of the kind where a pipe system containing the dye is adapted, at unwarranted attempts at opening, to be activated by a release mechanism to release pressure energy for dispersing the dye over the securities.

Trunks for transportation of bank notes are known, wherein a built-in pipe system with apertures for dispersal of the dye can be activated by a release mechanism connecting a pressure container with propelling charge and dye to the pipe system or releasing the propelling charge in a pressure container for forcing dye from a separate dye container out into the pipe system.

It is the object of the invention to provide an apparatus of the kind in question comprising a pipe system which is simpler and cheaper in construction than those hitherto known and which, besides, is more reliable in operation and easier to renovate.

The apparatus according to the invention is characteristic in that each of the pipes of the pipe system comprises a pressure rail constituting a portion of the wall of an oblong chamber, said wall portion being displaceable at release of pressure energy, and said chamber containing a tubular bag with a dye, the wall of said chamber situated opposite to the pressure rail being perforated by one or more longitudinal slots.

The pipes of the system can be produced in a cheap and easy manner as extruded profiles, and the direct influence exerted on the bags with dye immediately under the slot through which the ejection of dye is to be performed, ensures an effective ejection from the entire system without any risk of clogging up or weaker ejection in certain parts of the system because of pressure drop in a pipe system. Besides, the pipe system is easy to clean and renovate by insertion of new bags with dye.

By arranging, according to the invention, knife members at the slot in the chamber containing the bag with dye, it is ensured that the bag will burst only immediately opposite to the slot, which permits a correct control of the dye jets.

By the embodiment described in claim 3 a practically simultaneous ejection from the entire system, a first strong pressure generation in the space between the supporting walls for cutting the bag open, and a subsequent uniform distribution of the pressure in the larger space under the T-rail involving a quiet and uniform compression of the bag with dye, are obtained. The rupture indications under the explosive charge ensure a controllable location of rupture and a practically simultaneous explosion all over the bottom of the body containing the explosive material.

A further security that the bag is simultaneously compressed all over is obtained by using a pivotally hinged pressure rail as described in claim 4. In this case as well, a two-stage explosion may be obtained by constructing the apparatus as described in claim 5, which involves a first strong pressure generation making the rupture indications in the wall of the chamber containing the explosive charge burst and causing the dye bag to be cut open along the slot, and a subsequent pressure distribution blowing the entire pipe system clean of dye at uniform compression.

By the subject matter of claim 6 it is obtained that the pressure rail keeps the bag in compressed condition so that reflux of the dye fluid is prevented, and by the embodiment according to claim 7 it is secured that the bag remains in the chamber during the explosion and the subsequent compression.

A safe control of the dye jets so as to be directed to stacked bank notes, securities, coins or other articles of value is obtained by arranging the pipe system in a tray as described in claim 8.

To prevent an unintended outflow of dye at leakage of the bag, the slot may be covered, as referred to in claim 9, by a penetrable seal.

As stated in claim 10, the pipe system may be built of several independent units, thereby obtaining a further security that the apparatus will function at attempts at opening the trunk.

Figure 2:
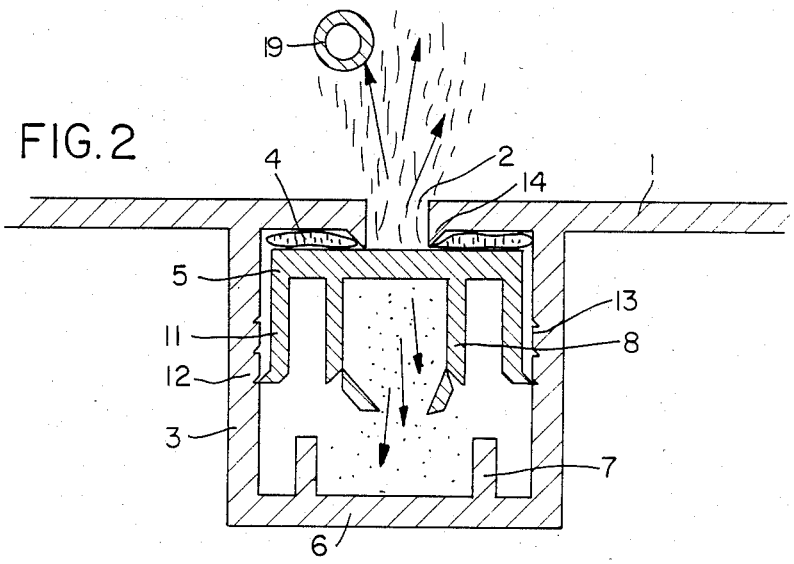
Figure 3:
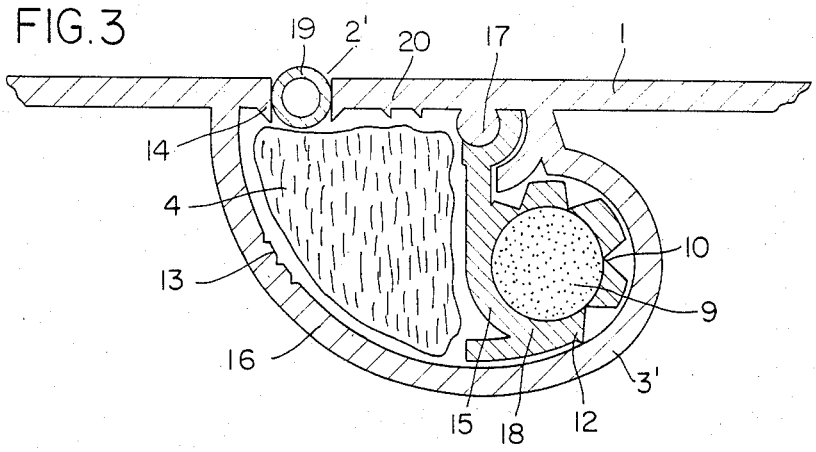
Figure 4:
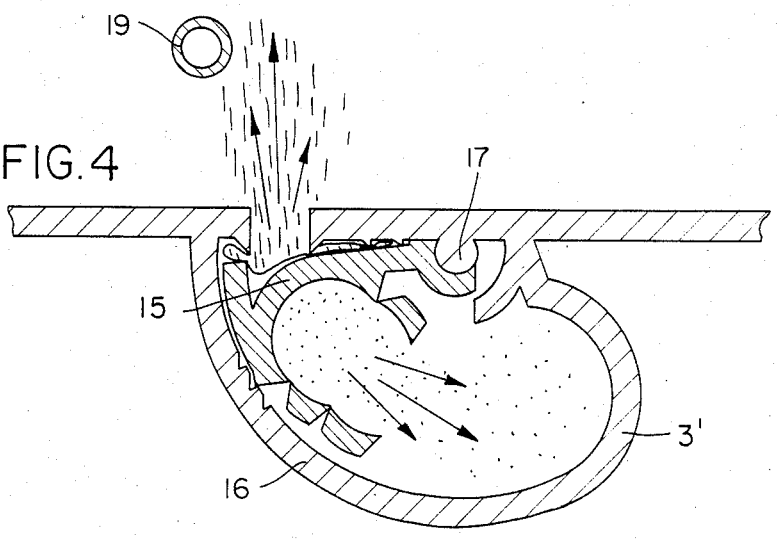
Figure 5:
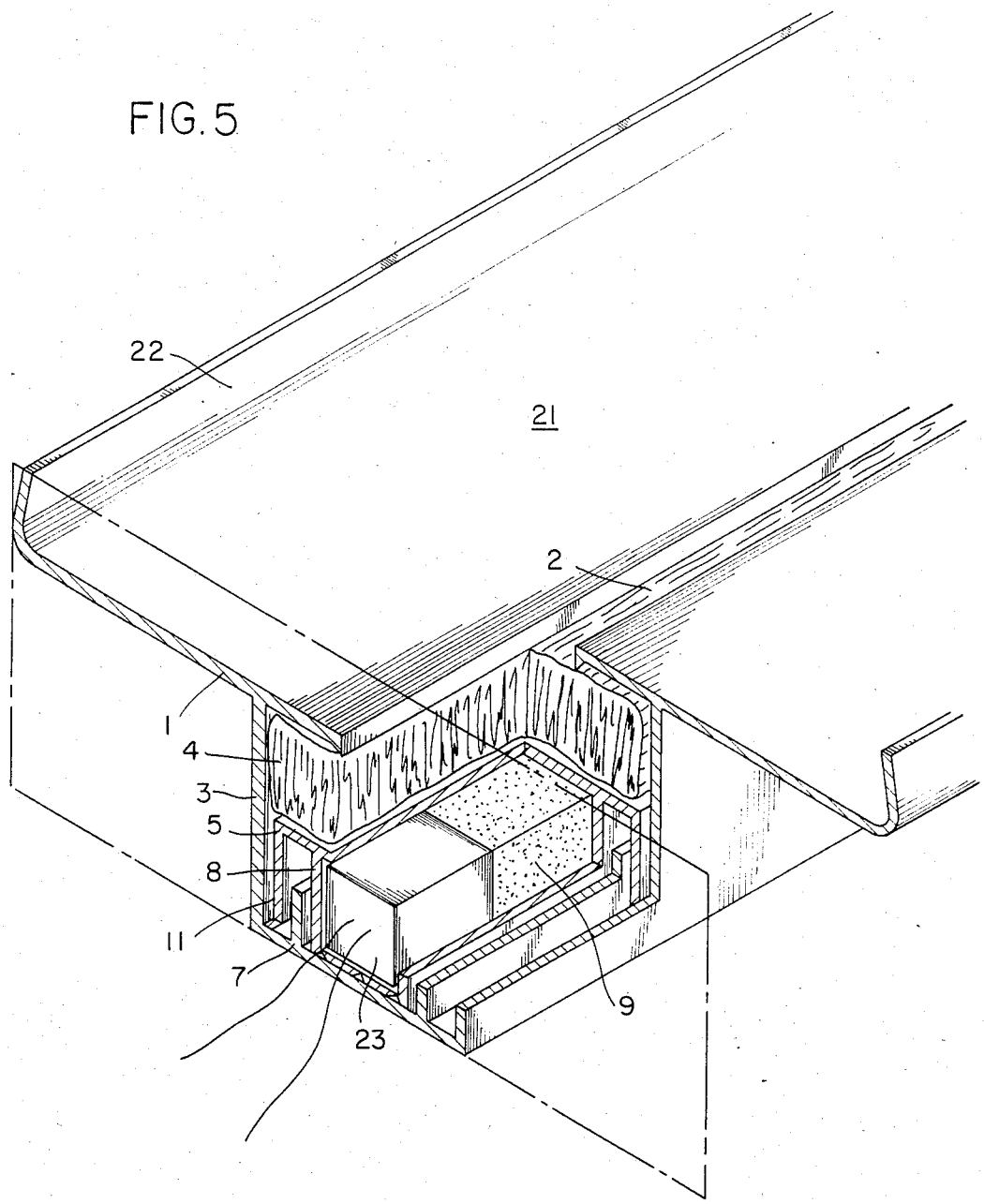

In the following the invention will be explained in details with reference to the drawing wherein:

FIG. 1 shows a section through a portion of the pipe system in an embodiment of the apparatus according to the invention in position of preparedness, FIG. 2 the same at ejection of dye, FIG. 3 a section through a pipe in a second embodiment of the apparatus according to the invention, FIG. 4 the same at ejection of dye, and FIG. 5 a partially cut up isometric partial view of a pipe system corresponding to that shown in FIG. 1.

FIGS. 1 to 4 of the drawing show a portion of a bottom 1 of a tray adapted to be arranged in a trunk, a safe or a corresponding depository for articles of value. The bottom is provided with a longitudinal slot 2 extending in the longitudinal direction over a chamber in a pipe which in FIG. 1 is formed as a box-shaped profiled housing 3. In the profiled housing 3 a dye bag 4 containing a highly colouring liquid is arranged. The bag is supported by a longitudinal pressure rail 5 extending, like the bag, over the entire length of the profiled housing 3. The pressure rail 5 has a substantially T-shaped cross-section, and the bottom wall 6 of the profiled housing comprises upright supporting walls 7 forming a guide for the body 8 of the T-rail which is formed as a chamber containing an explosive charge 9, the bottom of which chamber is formed with weakening lines or corresponding rupture indications 10.

By activating an igniter 23 (FIG. 5) the explosive charge 9 is made to explode causing the bottom with the rupture indications 10 to burst, and a heavy excess pressure will arise in the space between the supporting walls 7. The pressure rail 5 and the dye bag 4 with it are thereby thrown in the direction towards the slot 2, and the bag is cut open by knives 14 extending along the slot 2 whereafter it is compressed, the pressure from the explosion in the meantime propagating evenly in the entire space under the pressure rail. During its movement the pressure rail 5 is guided by guide flanges 11 extending parallel to the stem of the T and comprising ribs 12 cooperating with rib-like projections 13 at the inner side of the housing wall for retaining the pressure rail in the position shown in FIG. 2, after the colouring liquid has been pressed out of the bag. Reflux of ejected dye liquid through the slot 2 is thereby prevented. In order to prevent, at leakage of the bag 4, that dye liquid overflows the bottom 1 and destroys articles of value placed thereon, the slot is normally closed by a seal 19 which is broken and thrown away when the explosive charge 9 explodes, vide FIG. 2.

The igniter is activated in known manner at any attempt to break open the space wherein the articles of value are kept, or after expiration of a certain previously adjusted period of time. Moreover, in a manner known as well, the explosion may be released by water penetrating into the space or by the temperature in the space moving outside previously fixed limits. The explosive charge and the igniter are enclosed in watertight manner.

The even compression of the dye bag 4 over the entire length of the profiled housing 3 ensures an even ejection all over through the slot 2 without, like in prior art pipe systems, there being a risk of insufficient ejection caused by pressure drop or clogging up in the pipe lines. The profiled pipes as well as the pressure rail may be produced in a relatively cheap manner as extruded profiles, preferably of aluminium.

In the embodiment shown in FIGS. 3 and 4, the pipe system consists of profiled housings 3' in which the dye bag 4 is arranged in one side under the slot 2', and the pressure rail 15 is arranged in the other side thereof. The pressure rail 15 is mounted at a hinge connection 17 in a way so that at release of the explosive charge it will move along a wall 16 shaped as a circular arc and press the bag 4 up against the knives 14 and the slot 2'. In this embodiment, the explosive charge 9 is arranged in a tubular explosive-charge chamber 18 disposed at the back of the pressure rail and provided with rupture indications 10. When the bag has been cut open by the knives 14, it is compressed during the equalization of the pressure in the entire space of the profiled housing 3'. After the compression of the bag, the rail is held in a pawl-like manner by the rib 12 engaging corresponding ribs or teeth 13 in the chamber wall. A further security for a simultaneous compression of the bag 4 over the entire length thereof is achieved by the pivotal mounting of the pressure rail 15. Gripping cams 20 retains the bag within the chamber at the explosion.

In all embodiments of the apparatus according to the invention, the tray 21 wherein the securities or corresponding articles are placed, may have side walls 22 rising from the bottom 1 and curving inwards towards the middle of the tray, thereby guiding flowing liquid inwards towards the securities kept in the tray. Besides, the tray may be formed in any suitable way to receive individual sorts of valuable articles which may be supported by clamps or rack systems, and the bottom of the tray may be formed e.g. like a wicker bottom where liquid which is not immediately absorbed by the securities, may collect in the indentations of the wicker work.

It will be understood that the apparatus according to the invention may be constructed in several ways different to those described here and that, if desired, the bag 4 may be filled with other means than dye liquid to be used in other cases where it is desired to eject a medium in a closed container. Moreover, under the bottom 1 any number of pipes may be arranged parallel to or crossing each other, and the pipe system may be built of several independently operating units, each comprising a pressure release unit, thereby achieving a further security that the system will function at attempts at breaking the space open.

I claim:

1. An apparatus for dispersing a dye over securities kept in a closed space, at attempts to break open such a space, e.g., a trunk or a safe-deposit box, and of the kind where a pipe system including a pipe and containing the dye is adapted, at unwarranted attempts at opening, to be activated by a release mechanism to release pressure energy for dispersing the dye over the securities, characterized in that said pipe comprises a longitudinal pressure rail constituting a portion of the wall of an oblong chamber, said chamber containing a tubular bag with a dye, the wall of said chamber situated opposite to the pressure rail being perforated by one or more longitudinal slots, said pressure rail being displaceable toward said opposite wall at release of pressure energy to compress said bag and force said dye out through said slot, said pipe system comprising a box-shaped profiled housing wherein the dye bag and the pressure rail are arranged in a common space, said pressure rail being T-shaped with a body, the top wall of the housing being interrupted by the longitudinal slot, and the bottom wall comprising two upright supporting walls surrounding the body of the pressure rail, said body forming a chamber with an explosive charge which is ignited by an electronic ignition system and having below a bottom formed with rupture indications.

2. An apparatus for dispersing a dye over securities kept in a closed space, at attempts to break open such a space, e.g., a trunk or a safe-deposit box, and of the kind where a pipe system including a pipe and containing the dye is adapted, at unwarranted attempts at opening, to be activated by a release mechanism to release pressure energy for dispersing the dye over the securities, characterized in that said pipe comprises a longitudinal pressure rail constituting a portion of the wall of an oblong chamber, said chamber containing a tubular bag with a dye, the wall of said chamber situated opposite to the pressure rail being perforated by one or more longitudinal slots, said pressure rail being displaceable toward said opposite wall at release of pressure energy to compress said bag and force said dye out through said slot, said pipe system comprising a profiled housing wherein the bag is arranged at one side opposite the slot, and the pressure rail is pivotally hinged along a wall situated opposite to the slot and having a cross section shaped like a circular arc.

3. An apparatus for dispersing a dye over securities kept in a closed space, at attempts to break open such a space, e.g., a trunk or a safe-deposit box, and of the kind where a pipe system including a pipe and containing the dye is adapted, at unwarranted attempts at opening, to be activated by a release mechanism to release pressure energy for dispersing the dye over the securities, characterized in that said pipe comprises a longitudinal pressure rail constituting a portion of the wall of an oblong chamber, said chamber containing a tubular bag with a dye, the wall of said chamber situated opposite to the pressure rail being perforated by one or more longitudinal slots, said pressure rail being displaceable toward said opposite wall at release of pressure energy to compress said bag and force said dye out through said slot, said pipe system being arranged in a tray the sidewalls thereof rising from the bottom and curving inwards towards the middle of the tray.

4. An apparatus for dispersing a dye over securities kept in a closed space, at attempts to break open such a space, e.g., a trunk or a safe-deposit box, and of the kind where a pipe system including a pipe and containing the dye is adapted, at unwarranted attempts at opening, to be activated by a release mechanism to release pressure energy for dispersing the dye over the securities, characterized in that said pipe comprises a longitudinal pressure rail constituting a portion of the wall of an oblong chamber, said chamber containing a tubular bag with a dye, the wall of said chamber situated opposite to the pressure rail being perforated by one or more longitudinal slots, said pressure rail being displaceable toward said opposite wall at release of pressure energy to compress said bag and force said dye out through said slot, the slot being covered by a penetrable seal.

5. An apparatus for dispersing a dye over securities kept in a closed space, at attempts to break open such a space, e.g., a trunk or a safe-deposit box, and of the kind where a pipe system including a pipe and containing the dye is adpated, at unwarranted attempts at opening, to be activated by a release mechanism to release pressure energy for dispersing the dye over the securities, characterized in that said pipe comprises a longitudinal pressure rail constituting a portion of the wall of an oblong chamber, said chamber containing a tubular bag with a dye, the wall of said chamber situated opposite to the pressure being perforated by one or more longitudinal slots, said pressure rail being displaceable toward said opposite wall at release of pressure energy to compress said bag and force said dye out through said slot, said pipe system comprising several independently functioning units each of which comprises a pressure release unit, e.g., an electric igniter.

6. An apparatus according to claim 2, characterized by the pressure rail being formed at the side thereof remote of the dye bag with a tubular chamber for the explosive charge, said chamber having rupture indications in the wall thereof situated opposite to the rail.

7. An apparatus according to claim 2, characterized by the pressure rail comprising cam- or rib-shaped means cooperating with rib-shaped projections (13) on the side wall of the profiled housing to secure the pressure rail by pawl and ratchet effect when the dye bag has been squeezed together.

8. An apparatus according to claim 2, characterized in that the inner wall of the chamber containing the dye bag comprises gripping cams or teeth for retaining the bag within the chamber at the explosion.

* * * * *